US005988534A

United States Patent [19]

Kost et al.

[11] Patent Number: 5,988,534

[45] Date of Patent: Nov. 23, 1999

[54] SPREADER MOUNT ASSEMBLY

[75] Inventors: James A. Kost, Willoughby; Elias J. Georgakopoulos, Cleveland, both of Ohio

[73] Assignee: The Louis Berkman Company, Steubenville, Ohio

[21] Appl. No.: 09/093,575

[22] Filed: Jun. 8, 1998

[51] Int. Cl.[6] ..... A01C 15/00; A01C 23/00

[52] U.S. Cl. ..... 239/650; 239/663

[58] Field of Search ..... 239/676, 650, 239/663; 16/354; 70/202, 134, 55, 56; 292/67, 307 R, 218; 296/37.6, 50

[56] References Cited

U.S. PATENT DOCUMENTS

| | | | |
|---|---|---|---|
| 3,387,406 | 6/1968 | Coker et al. | 296/50 |
| 3,454,299 | 7/1969 | Hewitt et al. | 296/50 |
| 4,076,301 | 2/1978 | Gergoe | 296/50 |
| 4,166,581 | 9/1979 | Hetrick . | |
| 4,712,717 | 12/1987 | Egerdahl | 239/663 |
| 4,790,589 | 12/1988 | Moore et al. | 239/50 |
| 4,991,781 | 2/1991 | Barbieri . | |
| 5,286,158 | 2/1994 | Zimmerman | 239/650 |
| 5,375,773 | 12/1994 | Lewis | 239/650 |

*Primary Examiner*—Andres Kashnikow
*Assistant Examiner*—Davis Hwu
*Attorney, Agent, or Firm*—Vickers, Daniels & Young

[57] ABSTRACT

An improved spreader assembly adapted to be mounted on a the rear end of a cargo bed of a vehicle. The spreader assembly includes a spreader gate, a gate connector adapted to pivotably move the spreader gate about a substantially vertical axis enabling the gate to be swung away from said cargo bed, to expose an opening between the sidewalls of the cargo bed, and a spreader mount connected to the gate and extending rearwardly therefrom. The spreader gate includes a two gate sections positionable with respect to one another to provide a variable longitudinal length of the gate.

37 Claims, 9 Drawing Sheets

SPREADER MOUNT ASSEMBLY

This invention relates to the art of spreading particulate material and more particularly to an improved mounting assembly for mounting a spreader onto a vehicle.

BACKGROUND OF THE INVENTION

Salt spreading is a common practice to maintain roads during the winter months. Over the years, private businesses have become involved in road, driveway and parking lot maintenance in the form of removing snow from such areas and spreading of salt on such areas. Private businesses typically use pick-up trucks to perform this type of service. In the past, numerous types of salt spreaders have been developed to be attached to the conventional vehicles. Typically, the spreader is mounted on the rear of the vehicle to spread particulate material, such as salt, sand, cinders, etc. onto the surface being traveled by the vehicle. One of the more common spreaders employs a hopper having a lower discharge opening through which the particulate material falls onto a rotating spreader element. Such a spreader is known as a broadcast spreader. By rotating the spreader element as material is being discharged onto the spreader element, the particulate material is centrifugally propelled by the spreader element in a wide pattern onto the ground surface. Typically, a motor is mounted on the spreader to cause the spreader element to rotate. In some instances, the spreader element is support on a motor-driven shaft which protrudes upwardly into the hopper to break up conglomerations of material and to agitate the material in the hopper for better feeding through the discharge opening.

Typical salt spreader mount assemblies used in conjunction with pick-up trucks have fastened the salt spreader to the truck's rear bumper tailgate. The usual procedure is that the spreader is secured to the truck in a fixed position by the use of bolts and brackets. Due to the relative difficulty in installing the assembly, such assemblies are left on during the spreading season and are not removed until the season ends. Another configuration available includes the use of brackets which slide over the tailgate and incorporates a frame which rests on the vehicle's bumper. The use of these two mounting assemblies restricts the access of an operator to the rear of the vehicle's cargo area via the tailgate. If the tailgate is to be opened, the spreader assembly must be disengaged from the tailgate and the hopper emptied prior to removal. Such a disassembly requires considerable time and labor merely to gain access to the cargo bay of the vehicle. In typical operations, the particulate material is loaded and stored in the cargo bay prior to being loaded into the hopper. However, due to the complexity of removing the assembly from the tailgate so that the tailgate can be opened and the cargo bay can be accessed through the tailgate, the tailgate is typically not used to access the cargo bay once the spreader assembly is attached to the tailgate. As a result, access to the cargo bay of the vehicle is limited and if access is desired, it must be over the side wall of the vehicle. This limited access increases the difficulty of loading particulate material and other objects into the cargo bay of the vehicle and to gain access to the particulate material for loading into the hopper. Typically, the spreader material, such as bags of road salt and/or cinder ash, must be lifted over the side walls of the cargo bed thus resulting in additional labor times for loading such cargo into the cargo bay and damages to the side walls of the vehicle.

A salt spreader mounting assembly disclosed in U.S. Letters Pat. No. 5,375,773 overcomes several of the problems associated with accessing the cargo bed via the tailgate when a spreader assembly is attached to the vehicle. The spreader mounting assembly disclosed in U.S. Pat. No. 5,375,773 includes a frame which attaches to the vehicle and includes pivoting connections between the frame of the vehicle so that the frame can be swung horizontally thereby permitted access to the tailgate of vehicle. Once the assembly is swung away from the tailgate of the vehicle, the tailgate may be opened, thereby allowing access to the rear cargo area of the vehicle via the tailgate. Although the spreader mounting assembly is an improvement over many of the prior spreader mounting assemblies, there are several disadvantages associated with such mounting assembly. Once such disadvantage is that the frame which supports the hopper and spreader must be fully swung from the tailgate so as to allow the tailgate to be opened. As a result, the vehicle must be positioned in an area so as to provide enough space to fully swing the frame away from the tailgate so that the tailgate may be opened. Another disadvantage with respect to this mounting assembly is that the frame components must be made of heavy gauged steel to support a hopper filled with particulate material as it is being swung from the tailgate of the vehicle. The heavier materials which must be used for the construction of the frame result in additional costs and difficulty in moving the frame by an operator. A further disadvantage is that once the frame is swung away from the tailgate, the hopper is out of position to allow for easy loading of the particulate material into the hopper. While the tailgate is open, the frame cannot be swung back to its closed position since the end of the tailgate would engage the hopper and/or rotating spreading element and thereby damage such component. Another disadvantage is that the mounting bracket for the mounting assembly must be bolted to the top of the side wall of the vehicle. As a result, bolt holes must be drilled into the top of each of the side walls to secure the bracket to the top of the side walls. The resulting holes permanently disfigure the vehicle and can result in rusting of the vehicle around the drilled bolt holes. A further disadvantage of the spreading mounting assembly is that the outer surface of the tailgate can be damaged if the tailgate is not properly closed prior to the frame being closed and secured to the rear of the vehicle. Another disadvantage is that the spreader assembly is not easily adaptable to a variety of differing width cargo beds, thereby limiting the utility of such mounting assembly to specific sized trucks.

In view of the deficiencies of the present spread mounting assemblies, there is a need for a salt spreader mounting assembly that will allow easy access to the rear of the vehicle's cargo area, provides for easy loading of the spreader hopper from the cargo bay of the vehicle, minimizes permanent damage to the vehicle and can be used in a wide variety of trucks.

SUMMARY OF THE INVENTION

The present invention relates to an improved spreader mounting assembly to support a spreader at the rear of the vehicle, and more particularly, to an improved spreader assembly which provides quick and easy access to the rear cargo area of a vehicle.

In accordance with the invention, there is provided a spreader gate which is attached to the rear of a vehicle and is designed to substantially close an opening between the two side walls of a cargo bay. A gate connector is provided to pivotly move the spreader gate about a substantially vertical axis thereby enabling the spreader gate to be swung away from the cargo bed. A spreader mount is also provided which is connected to the spreader gate and extended rearwardly therefrom. The hopper mount is designed to support a hopper. The spreader gate is designed to be substituted for the original tailgate of the vehicle. Prior to installing the spreader gate, the original vehicle gate is removed. The spreader gate is then installed and is designed to close the opening between the two side walls of the cargo bay without the need of the original tailgate. The elimination of the original vehicle tailgate allows an operator to easily gain access into the cargo bay by merely swinging open the spreader gate. As can be appreciated, the spreader gate need not be swung completely open for an operator to access the cargo bed of the vehicle. The spreader gate need only be swung open a sufficient amount to enable the operator to move around the end of the spreader gate and access the cargo bay. Consequently, only a minimum amount of movement of the spreader gate is required to allow an operator to gain easy access to the cargo bay area of the vehicle. In addition, the spreader gate does not require a significant amount of space for opening to allow an operator to gain access to the cargo bay area. The use of the gate spreader also allows the operator to conveniently transfer particulate material from the cargo bed into a hopper mounted on the spreader gate. Such a configuration allows for efficient and easy loading and reloading of the hopper with particulate material during operation of the spreader.

In accordance with another aspect of the present invention, the spreader gate includes a plurality of sections to enable the length of the spreader gate to be adjusted for use in a variety of tailgate configurations. There exists a variety of tailgate sizes for pick-up trucks. Many of the foreign pick-up trucks have smaller tailgates than their American counterparts. The width of the cargo bed can also vary between manufacturers. The spreader gate of the present invention is designed to accommodate the wide variety of widths of tailgates. The gate sections of the spreader gate are designed to be variably positioned with respect to one another so that the length of the gate can be easily adjusted to fit a multitude of vehicle cargo bed configurations. In one embodiment, the spreader gate includes two gate sections wherein one gate section includes a sleeve adapted to receive an end of the second gate section. This arrangement allows the second gate section to slide into and out of the sleeve of the first gate section, thereby allowing for easy and convenient varying of the length of the spreader gate. In another embodiment, a gate section connector is provided to secure the plurality of gate sections together in a fixed position once the desired length of the spreader gate is obtained. The gate section connector may encompass a wide variety of mechanisms to secure the gate sections together. Such examples include bolts, locks, ratcheting assemblies, pins, screws, etc.

In accordance with another aspect of the present invention, the gate connector is positioned rearwardly of the cargo bed to allow the spreader gate to be easily swung away from the cargo bed. In one particular embodiment, a portion of the gate connector is mounted onto the rear bumper of the vehicle. The connector may be mounted by brackets and/or by inserting holes into the rear bumper and bolting or otherwise connecting the gate connector to the rear bumper of the vehicle. In a preferred embodiment, the gate connector includes a sleeve extending vertically from the top of the vehicle bumper. The sleeve is designed to rotate about a pin to enable to spreader gate to be swung away from the cargo bed. In another preferred embodiment, the gate connector includes a connector flange which is secured to the inner surface of the side wall of the cargo bay. In one particular embodiment, the connection flange is attached to interior surface by clamps and/or bolting the flange using existing holes in the side wall.

In accordance with yet another aspect of the present invention, the spreader gate includes a structure which minimizes the openings through the spreader gate so as to prevent materials in the cargo bed from passing through the spreader gate when the spreader gate is in the closed position. Such a design of the spreader gate enables the gate to effectively close the end of the cargo bay in the same affective manner as the original tailgate of the vehicle.

A still yet another aspect of the present invention, a spreader mount is attached to the spreader gate. The spreader mount includes a hopper frame which is designed to support a spreader hopper on the spreader gate. The spreader mount can be attached to the spreader gate by a number of mechanisms such as brackets, bolts, screws, pins, rope, chains and the like.

The principal object of the present invention is to provide a spreader mounting assembly which allows quick and easy access to the rear cargo area of a vehicle.

Another object of the present invention is to provide a spreader mounting assembly which minimizes the space requirements for accessing the rear cargo area of a vehicle.

Yet another object of the present invention is to provide a salt spreader mounting assembly which allows for convenient refilling of the hopper during operation.

Still another object of the present invention is to provide a spreader mounting assembly which closes the end of the cargo area without the need of a tailgate.

Still yet another object of the present invention is to provide a spreader mounting assembly which minimizes the damage to a vehicle.

Another object of the present invention is to provide a spreader mounting assembly which is easy to install and remove.

Yet another object of the present invention is to provide a spreader mounting assembly which can be used in a wide variety of cargo bay design of vehicles.

Still another object of the present invention is to provide a spreader mounting assembly which can be attached to the rear of the vehicle and is designed to swing away from the rear of the cargo bay.

Another object of the present invention is to provide a spreader mounting assembly which is convenient and easy to operate.

These and other objects and advantages will become apparent to those skilled in the art upon the reading and following of this description taken together with the accompanied drawing.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENTS

Figure 1:
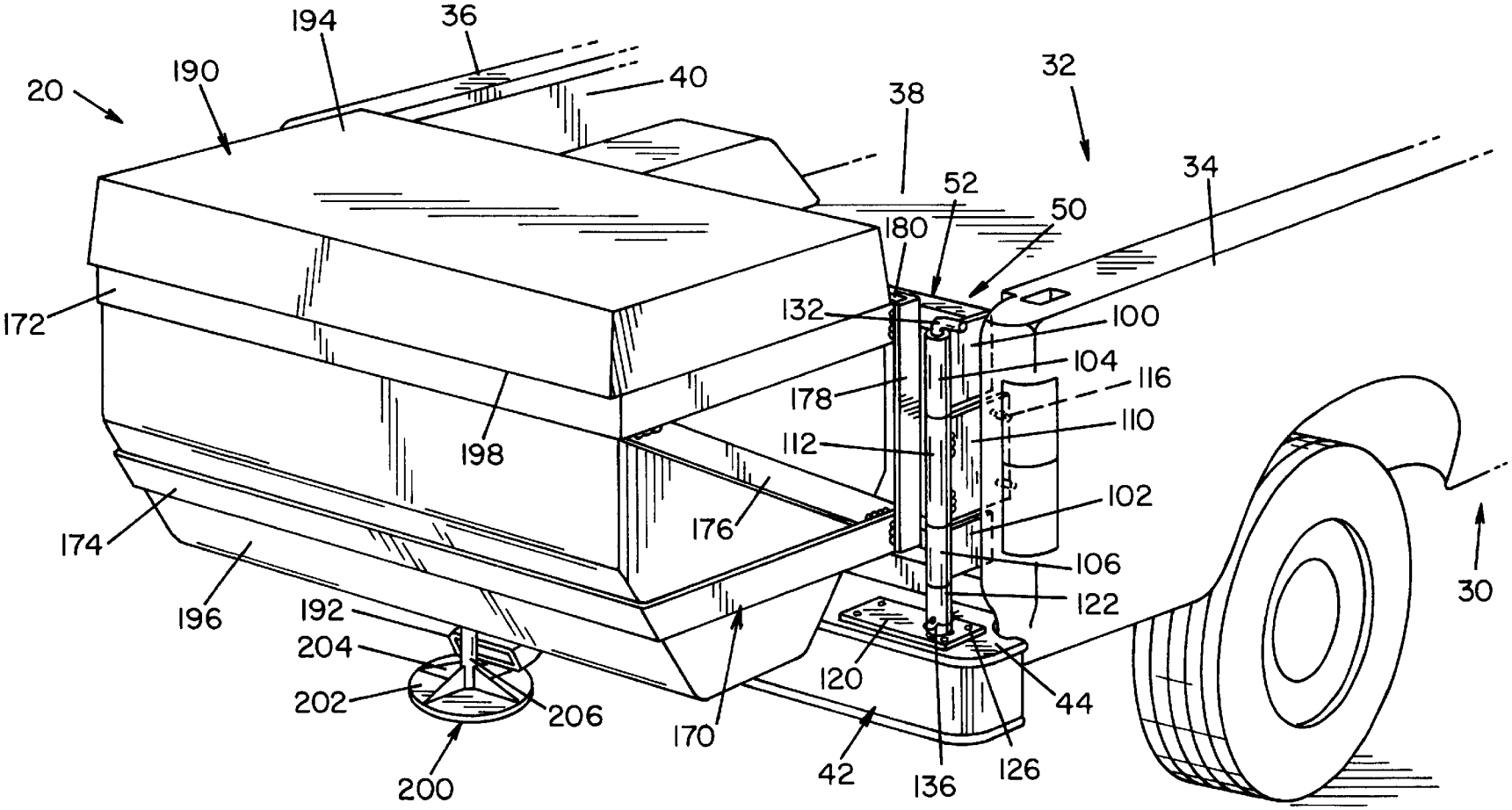
FIG. 1 is a perspective view of the spreader assembly attached to a vehicle.

Referring now to the drawings, wherein the showings are for the purpose of illustrating the preferred embodiments of the invention only and not for the purpose of limiting the same, in FIG. 1 there is shown a truck 30 having a spreader assembly 20 attached to the rear of the truck. Truck 30 includes a cargo bay 32 which is defined by two side walls 34, 36 and a floor 38. Truck 30 also includes a bumper 42 which is attached to the lower rear end of cargo bay 32.

Figure 2:
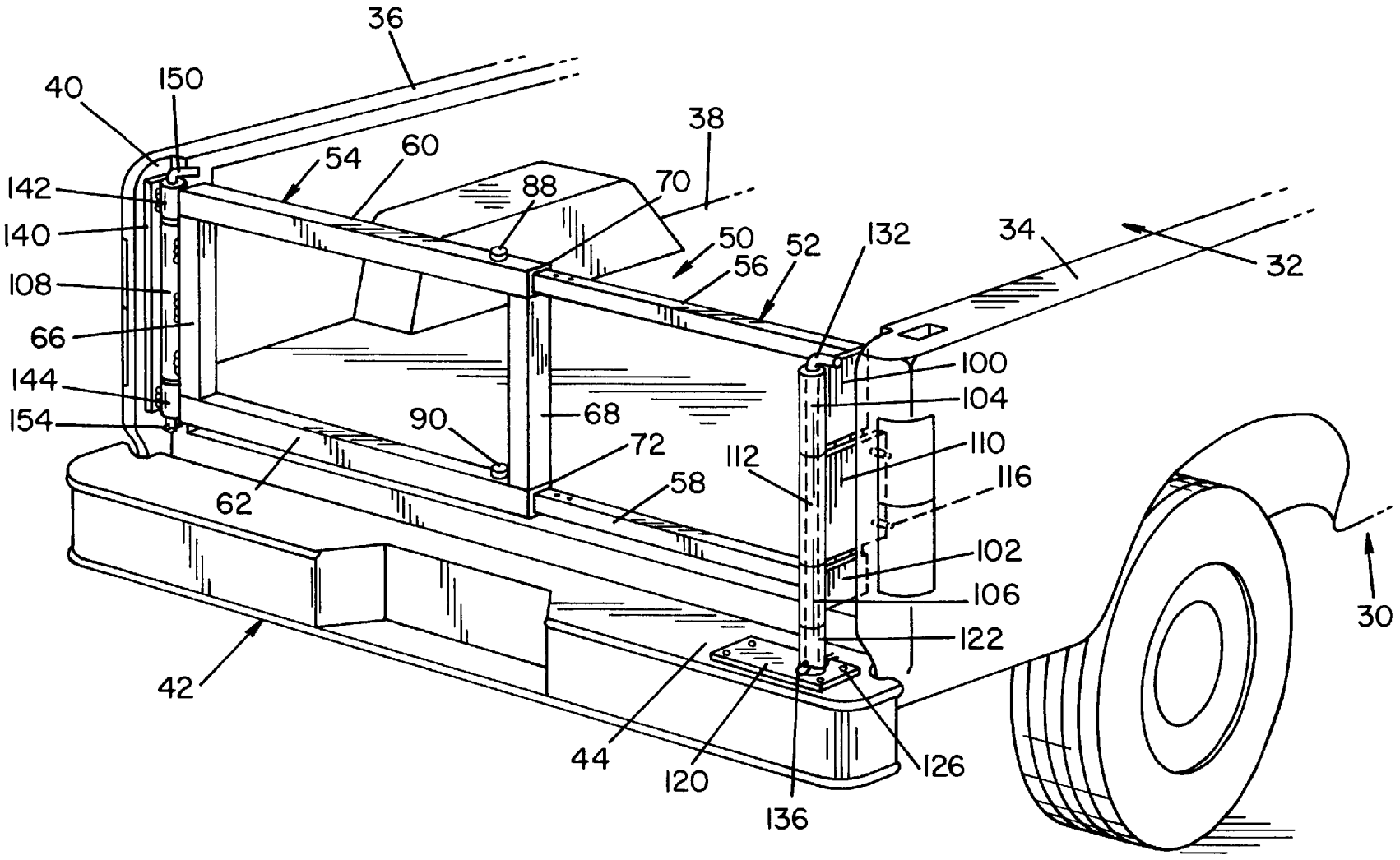
FIG. 2 is a perspective view of the mounted spreader gate without the hopper.
Figure 3:
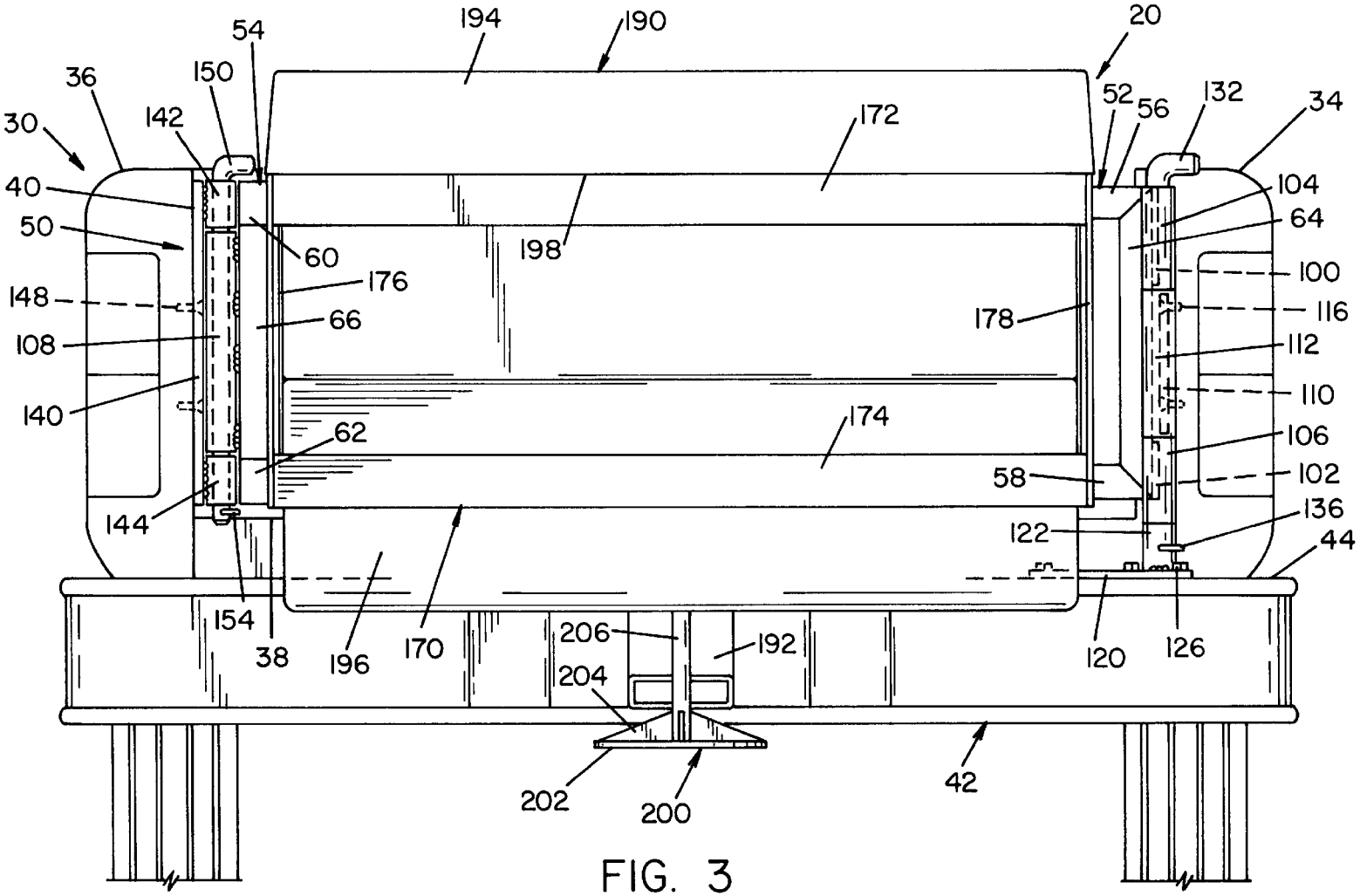
FIG. 3 is a rear view of the spreader assembly.
Figure 4:
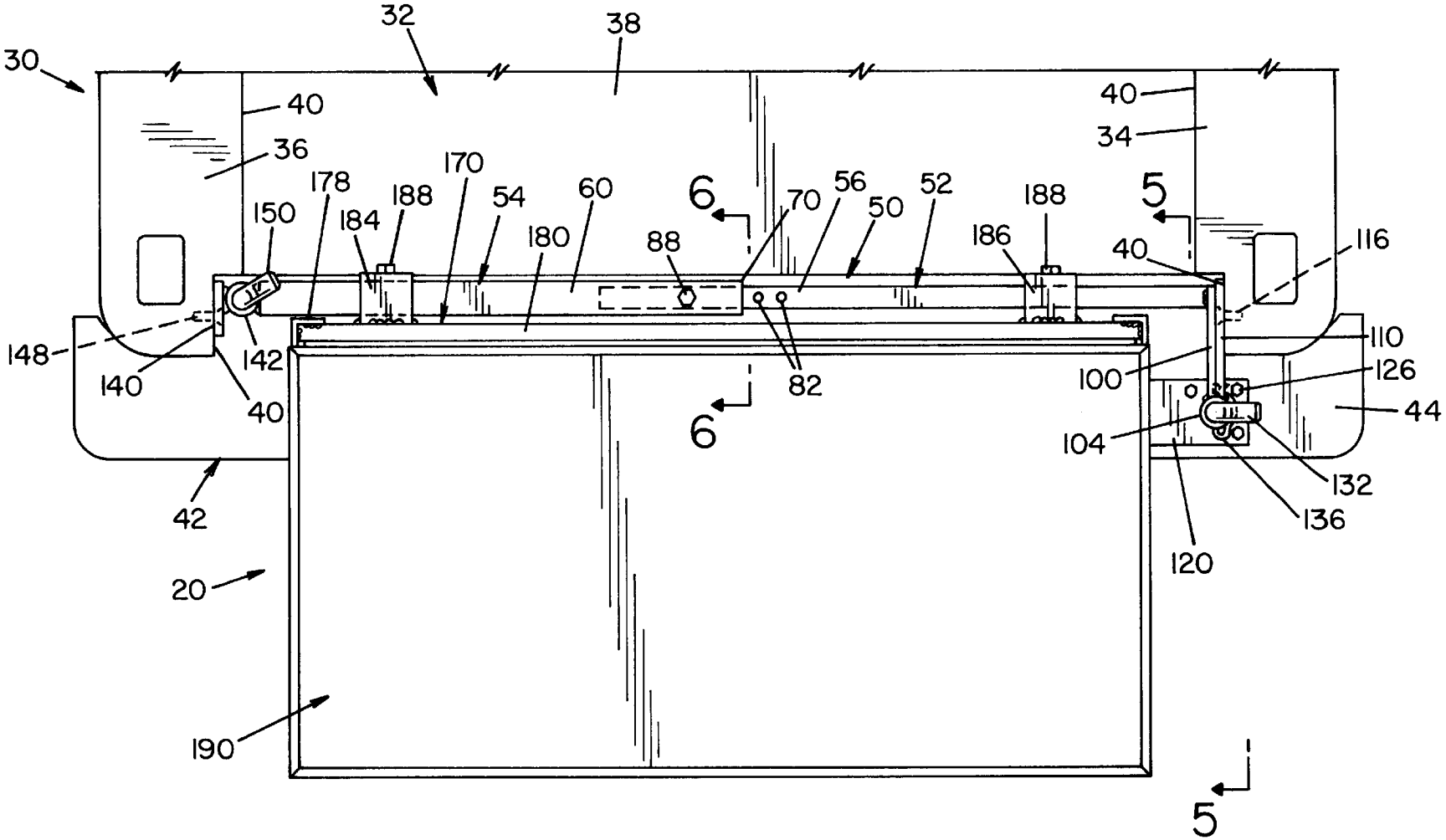
FIG. 4 is a top view of the spreader assembly shown in FIG. 3.
Figure 8:
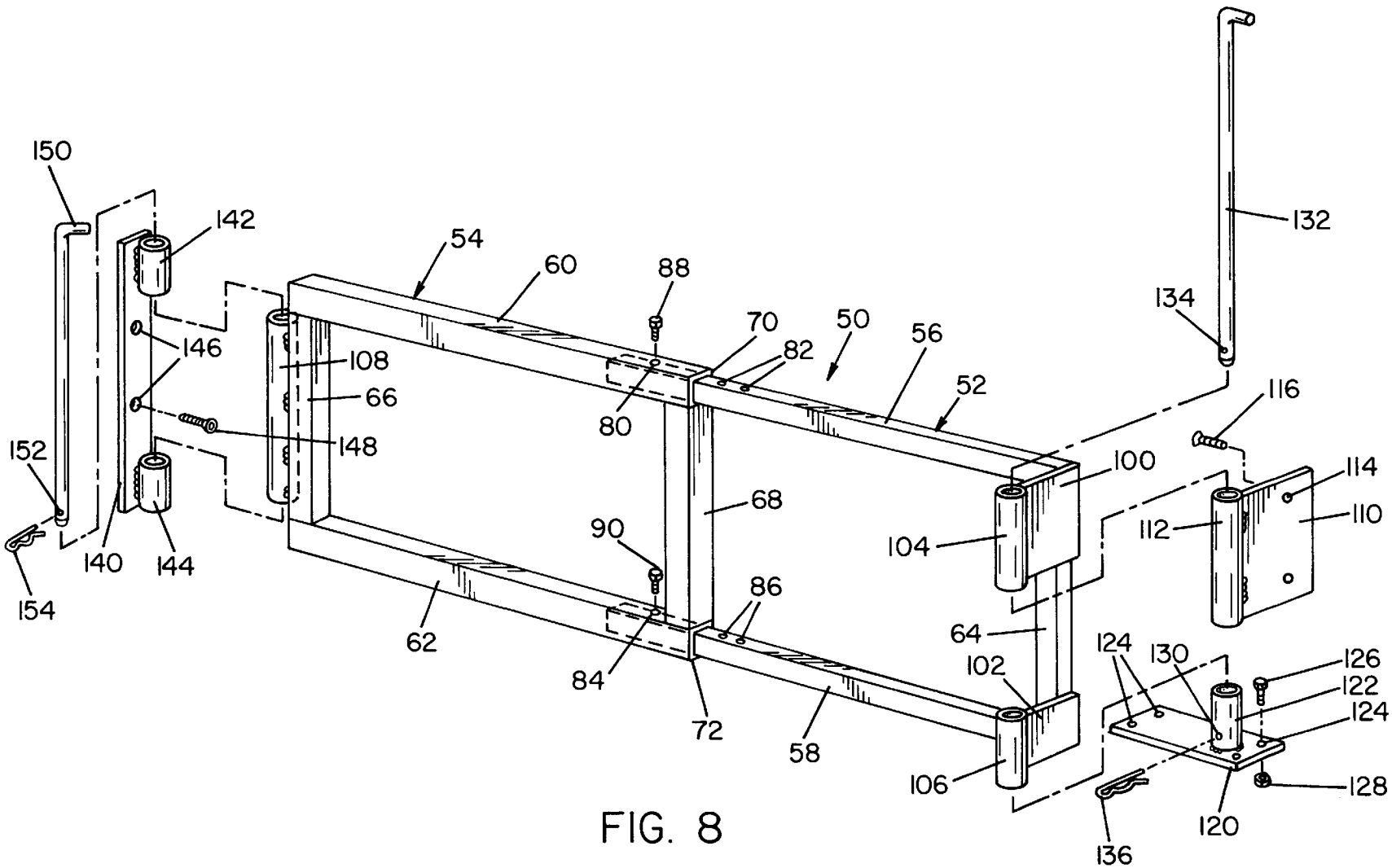
FIG. 8 is an exploded view of the spreader gate and mounting assembly of the spreader gate.

Referring to FIGS. 2 and 8, a spreader gate 50 is attached to the rear end of truck 30 and is positioned between side walls 34 and 36 of cargo bay 32. Spreader gate 50 includes gate section 52 and 54. Gate section 52 includes a section leg 64 and two section arms 56, 58 connected at the ends of section leg 64. Gate section 54 includes two section legs 66, 68 and two section arms 60, 62 connected at the ends of section leg 66, 68. Section arms 60 and 62 include arm sleeves 70, 72 respectively which are sized to receive the end of section arm 56, 58 of gate section 52. The arm sleeves telescopically receive the ends of the section arm of gate section 52, thereby enabling the spreader gate 50 to be adjustable along its longitudinal length. Arm openings 80, 82, 84, 86 are provided in section arm 56, 58, 60, 62. These arm openings are adapted to receive screw 88, 90 so as to secure the ends of section arms 56, 58, 60, 62 together, thereby rigidly fixing the longitudinal length of spreader gate 50. Section arms 56, 58 include multiple arm opening 82, 86 to allow spreader gate 50 to be secured in various longitudinal lengths. As shown in FIG. 8, mount sleeves 104 and 106 are secured to in gate flanges 102, 100, which in turn are secured to section leg 64 of gate section 52.

Referring to FIG. 2, spreader gate 50 is rotatably mounted to side wall 34 so that spreader gate 50 can be swung outwardly from the end of cargo bay 32. Prior to mounting spreader gate 50 to truck 30, the tailgate of truck 30 is removed. Afterwards, side plate 110 is secured to interior surface 40 of side wall 34 by inserting plate screws 116 through plate opening 114. Openings 114 which receive plate screws 116 in the inner surface and side wall 40 may be pre-existing holes or may be drilled into the inner surface 40. Connected to side plate 110 is a plate sleeve 112.

Bumper plate 120 is secured to bumper 42 on the top surface 44 of bumper 42. Bumper plate 120 includes several plate openings 124 which are designed to receive plate bolt 126. Plate bolt 126 is inserted through plate opening 124 and through corresponding openings in bumper 42 and is secured in place by plate nut 128. The opening in bumper 42 may be existing openings or may be drilled into bumper 42. Bumper plate 120 includes a bumper sleeve 122 which extends vertically from bumper plate 120. Preferably, bumper sleeve 122 is positioned with respect to plate sleeve 112 so that the opening in the sleeves are aligned with respect to one another.

Spreader gate 50 is secured to plate sleeve 112 and bumper sleeve 122 by positioning mount sleeves 104, 106 in alignment with plate sleeve 112 and bumper sleeve 122. Once the sleeves are aligned together, mount rod 132 is inserted through the openings in the sleeves and locked in position by mount pin 136 which is inserted through pin opening 130 of bumper sleeve 122 and through rod opening 134 of mount rod 132.

As shown in FIG. 2, lock plate 140 is secured to inner surface 40 of side wall 36. Lock plate 140 is secured to side wall 36 by inserting plate screws 148 through plate openings 146 and into corresponding openings in side wall 36. The openings in side wall 36 may be existing openings or may be drilled. Connected to lock plate 140 are securing sleeves 142, 144. These securing sleeves are spaced apart and the openings in the sleeves are aligned with respect to one another.

As shown in FIG. 8, section legs 66 of gate section 54 includes a lock sleeve 108. Lock sleeve 108 is designed to move between securing sleeves 142, 144 when spreader gate 50 is moved into the closed position. Spreader gate 50 is locked into position by inserting lock rod 150 through securing sleeves 142, 144 and lock sleeve 108. Lock rod 150 is secured in position by inserting lock pin 154 through rod opening 152. FIG. 2 illustrates spreader gate 50 positioned in the locked and closed position.

Figure 9:
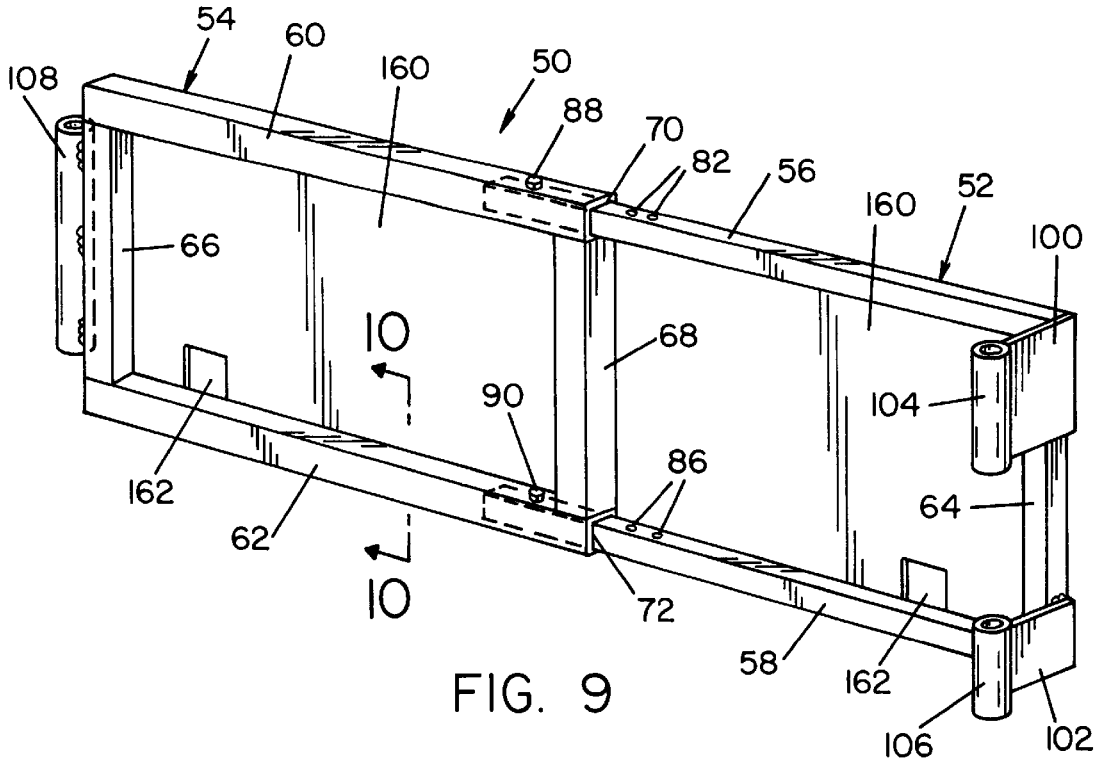
FIG. 9 is another embodiment of the spreader gate illustrating panels on the spreader gate.
Figure 10:
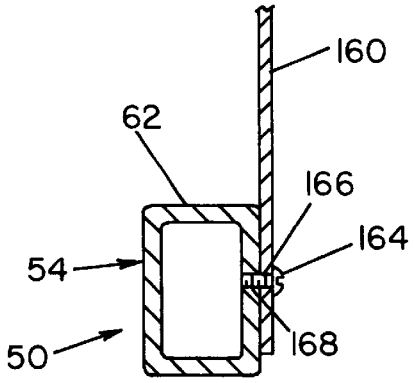
FIG. 10 is a cross-sectional view along line 10—10 of FIG. 9.

Referring now to FIGS. 9 and 10, spreader gate 50 may include a gate panel 160 connected to each of gate sections 52, 54. Gate panel 162 is secured to a gate section by inserting a panel screw 164 through panel opening 166 and into section arm and/or section leg of the gate section. Gate panel 160 may include a panel slot 162.

Figure 5:
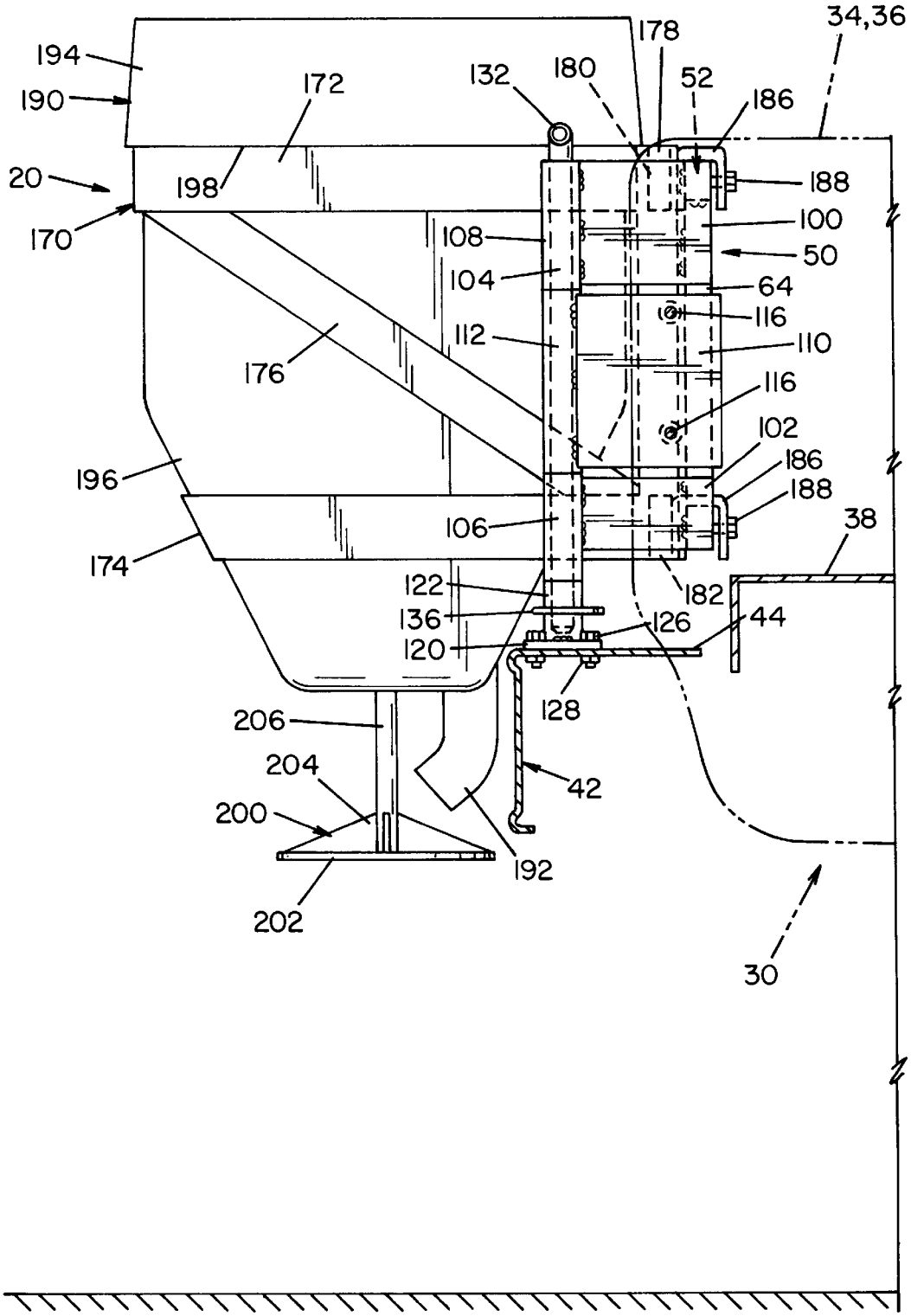
FIG. 5 is a cross sectional view along line 5—5 of FIG. 4.
Figure 6:
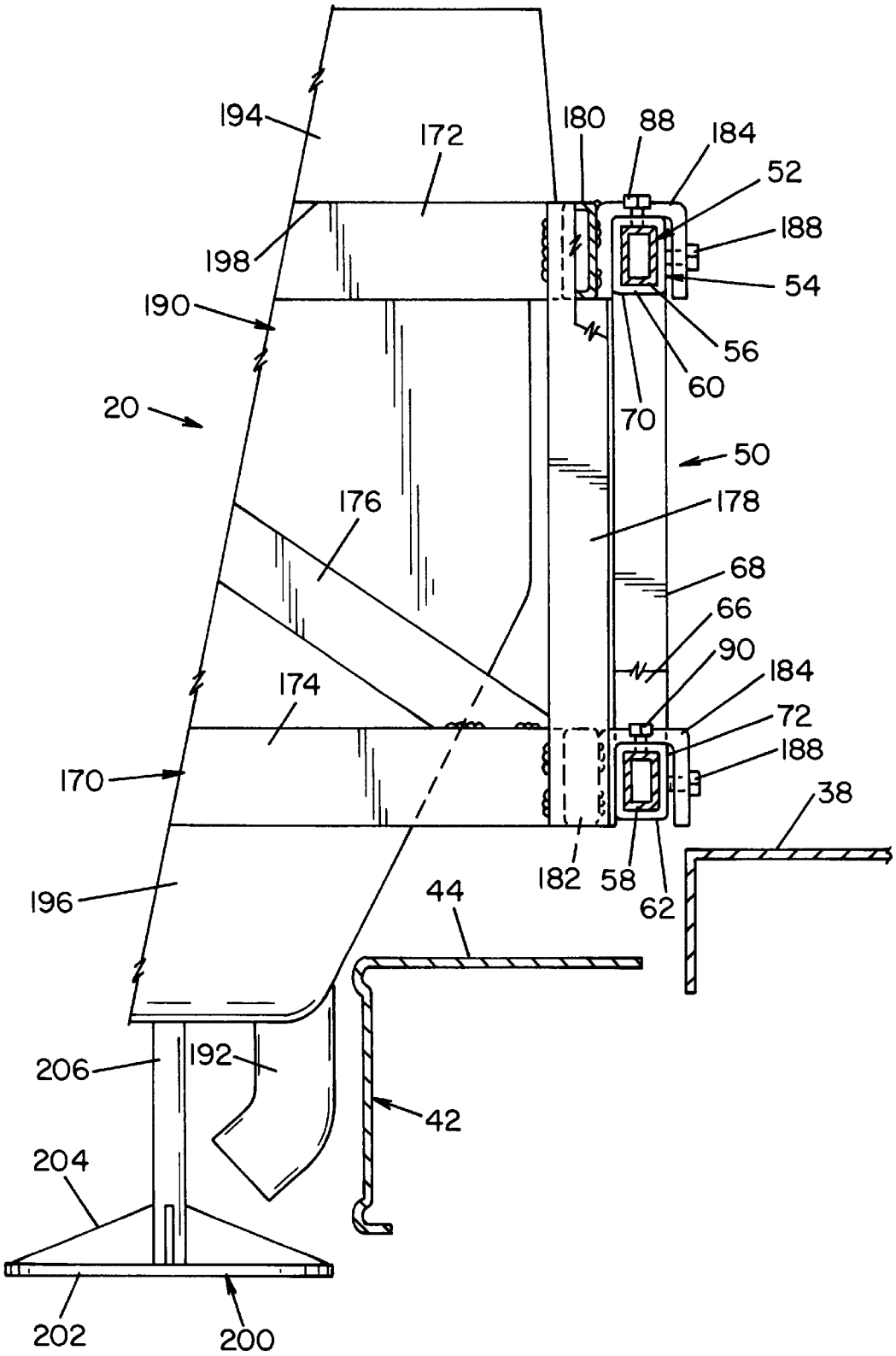
FIG. 6 is a cross sectional view along line 6—6 of FIG. 4.

Referring now to FIG. 1, a hopper mount 170 is secured to spreader gate 50. Hopper mount 170 includes an upper frame 172 and a lower frame 174. Upper frame and lower frame are held in a space relationship by rigidity bar 176. Upper frame and lower frame are secured to frame flange 176, 178. Rear bars 180, 182 are also secured to frame flanges 176 and 178. The hopper mount is designed to support a hopper 190 as shown in FIG. 1. Hopper mount 170 is secured to spreader gate 50 by mount hinges 184, 186. Mount hinges 184 186 are connected to rear bars 180, 182. The mount hinges are secured to spreader gate by inserting a hinge 188 bolt through mount openings in mount hinges 184, 186 and into section arm and/or section legs of spreader gate 50 as shown in FIG. 5.

Hopper 190 is a standard hopper which includes a hopper chute top section 194 and a bottom section 196. Bottom section 196 includes a hopper chute 192 designed to direct particular materials toward a broadcast spreader 200 having a disc 202, slingers 204 and rotated by drive shaft 206. As shown in FIG. 1, bottom section 196 is angularly designed so that a portion of the bottom section slips into lower frame 174 of hopper mount 170 and the remainder of the bottom section of hopper 190 is supported by lower frame 174. Hopper top section includes a top section ledge 198 designed to rest on the top portion of upper frame 172. Top section ledge 198 is designed to help support hopper 190 and hopper mount 170 so as to distribute the load forces between upper frame 172 and 174. Hopper 190 is shown to be covered so as to prevent rain, snow or other debris from entering into the hopper while the particulate material is in the hopper.

The operation of the spreader assembly will now be briefly described. Spreader assembly 120 is designed to be mounted in a variety of vehicles which include a rear cargo bay. One such type of vehicle are pick-up trucks and the like. The width of the cargo bay of pick-up trucks will vary depending on the type of truck and the manufacturer of the truck. Spreader assembly 20 is designed to be used in all types of these vehicles. When a hopper is to be mounted to the rear of the vehicle, the tailgate of the vehicle is removed prior to installing the spreader assembly onto the vehicle. The removal of the tailgate from the vehicle is relatively simple and will not be further described.

Once the tailgate is removed, side plate 110 and lock plate 140 are connected to the inner surface of the side walls of the truck. The inner surface of the side wall which is selected for mounting side plate 110 and lock plate 140 is the portion of the wall which is covered when the tailgate of the vehicle is positioned in the closed position. As a result, if holes need to be inserted in the inner surface of the side wall of the vehicle to mount the spreader gate 50 onto the vehicle, these openings will be covered once the spreader gate is disassembled from the vehicle and the tailgate of the vehicle is reattached and secured into the closed position of the vehicle. As a result, visible openings in the truck while the spreader gate is removed from the vehicle are not exposed.

After side plate 110 and lock plate 140 are secured to the side walls of the vehicle, bumper plate 120 is secured to the bumper of the vehicle. Bumper plate 120 is positioned on the bumper so that bumper sleeve 122 is aligned with plate sleeve 112 on side plate 110. Once bumper plate 120 and side plate 110 are mounted in position, the gate section 52 is positioned such that mount sleeve 104 and 106 are aligned with plate sleeve 112 and bumper sleeve 122. Once these sleeves are aligned, mount rod 132 is inserted through the openings in the sleeve thereby securing gate section 52 to side wall 34 of the vehicle. Mount rod 132 is then secured into place by mount pin 136.

Gate section 54 is then inserted over the ends of the section arms of gate section 52 and spreader gate 50 is moved into the closed position. Gate section 54 is adjusted in position until lock sleeve 108 is aligned with securing sleeves 142, 144 on lock plate 140. Once these sleeves are aligned together, lock rod 150 is positioned through the openings of such sleeves thereby locking spreader gate 50 into the closed position. Once the spreader gate 50 is locked in position, screws 80 and 90 are positioned through arm openings 80, 82, 84, 86 on gate section 52 and 54, thereby locking the gate sections in the desired position. If gate panels are to be secured to spreader gate, the gate panels are inserted onto the gate section at this time. Once the gate sections are secured in position by screws 88, 90, the hopper mount 170 is secured to the spreader gate. Hopper mount 170 is secured to spreader gate by lowering mount hinges 184, 186 onto the gate sections and securing the mounting hinges by hinge bolts 188 to the spreader gate. Once the hopper mount is secured in position on the spreader gate, hopper 190 is placed into the hopper mount thereby completing the assembly of the spreader assembly.

Figure 7:
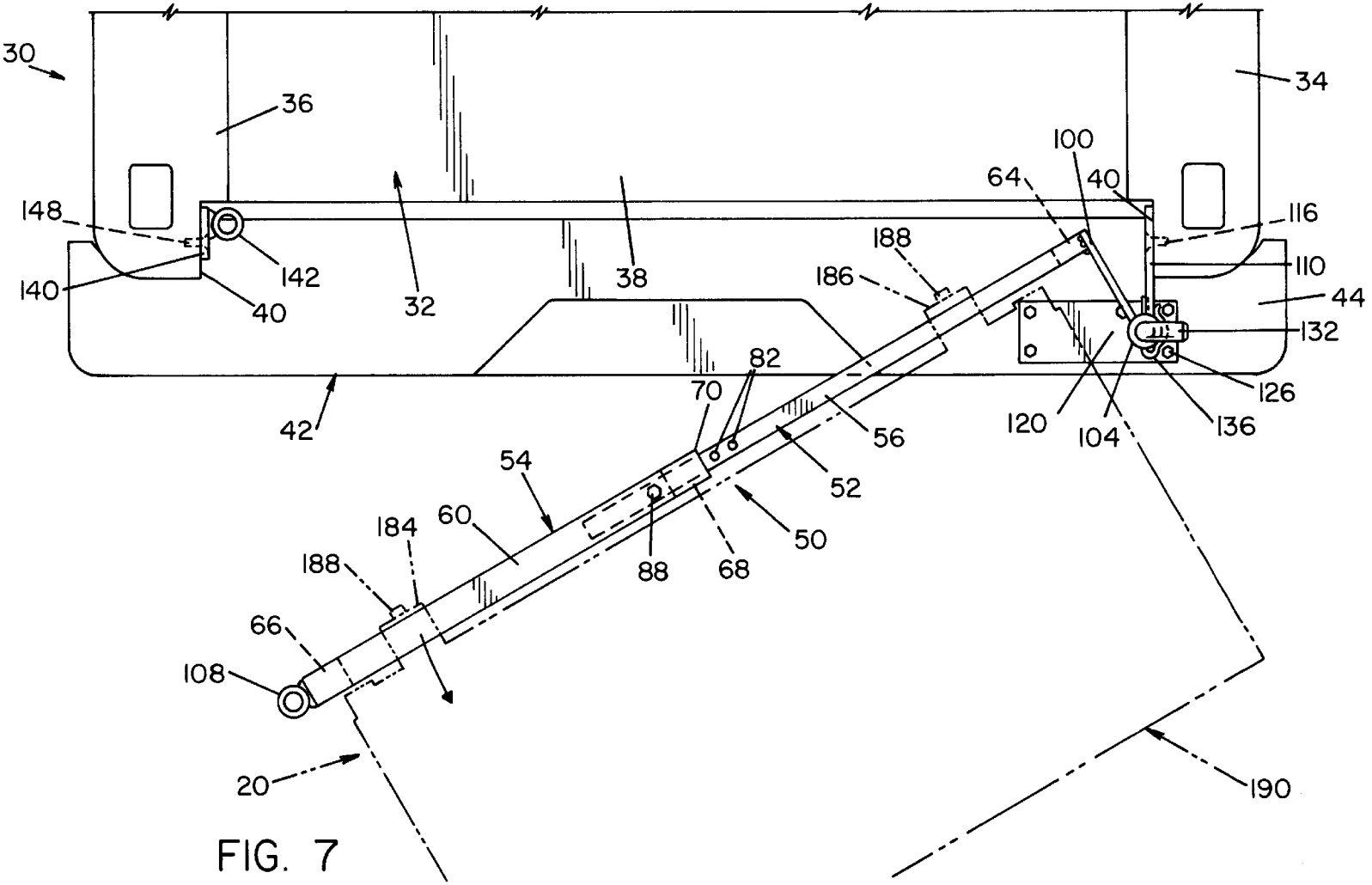
FIG. 7 is a top view of the spreader assembly illustrating the spreader gate in a partially open position.

Prior to spreading particulate material onto a ground surface, hopper 190 is filled with particulate material. During the operation of the spreader, the refilling of the hopper with particulate material can be easily accomplished by opening the cover of the hopper and refilling the hopper with particulate material. If particulate material is being stored in the cargo bay of the vehicle, the cargo bay of the vehicle can be easily accessed by removing lock rod 150 and swinging the gate outwardly from the cargo bay as shown in FIG. 7. The operator can then easily access the cargo bay and the spreader gate can be repositioned into the closed position. Thereafter, the operator can easily move the particulate material from the cargo bay and into the hopper. In addition, if the cargo bay of the vehicle needs to be replenished with particulate material, the spreader gate can be easily opened as described above to allow an operator to load the cargo bay area. As can be appreciated, spreader gate 50 need not be completely swung away from the vehicle to allow an operator to easily access the cargo bay. As shown in FIG. 7, spreader gate only needs to be opened a sufficient distance to allow the operator to move between the end of the spreader gate and the vehicle. This design of the spreader gate makes the access to the vehicle more convenient and allows for easier reloading of the cargo bay with particulate material and the replenishing of the hopper with particulate material.

The invention has been described with reference to a preferred embodiment and alternates thereof. It is believed that many modifications and alterations to the embodiments disclosed will readily suggest itself to the those skilled in the art upon reading and understanding the detailed description of the invention. It is intended to include all such modifications and alterations insofar as they come within the scope of the present invention.

We claim:

1. An improved spreader assembly adapted to be mounted on a vehicle, said vehicle includes a cargo bed, two sidewalls positioned opposite one another substantially on side edges of said cargo bed and extending substantially to a rear end of said cargo bed and an opening between said two sidewalls and substantially at said rear end of said cargo bed, the improvement comprising a spreader gate substantially closing said opening, a gate connector adapted to pivotably move said gate about a substantially vertical axis enabling said gate to be swung away from said cargo bed, thereby exposing said opening between said sidewalls and a spreader mount connected to said gate and extending rearwardly therefrom, said gate including a first and second gate section, said gate sections adapted to vary the longitudinal length of said gate between said opening.

2. The improvement as defined in claim 1, wherein said first gate section includes a sleeve adapted to receive an end of said second gate section.

3. The improvement as defined in claim 1, including a gate section connector to secure said gate sections together.

4. The improvement as defined in claim 3, including a gate section connector to secure said gate sections together.

5. The improvement as defined in claim 1, wherein said gate connector being positioned rearwardly of said cargo bed.

6. The improvement as defined in claim 4, wherein said gate connector being positioned rearwardly of said cargo bed.

7. An improved spreader assembly adapted to be mounted on a vehicle, said vehicle includes a cargo bed, two sidewalls positioned opposite one another substantially on side edges of said cargo bed and extending substantially to a rear end of said cargo bed and an opening between said two sidewalls and substantially at said rear end of said cargo bed, the improvement comprising a spreader gate substantially closing said opening, a gate connector adapted to pivotably move said gate about a substantially vertical axis enabling said gate to be swung away from said cargo bed, thereby exposing said opening between said sidewalls and a spreader mount connected to said gate and extending rearwardly therefrom, said gate connector being positioned rearwardly of said cargo bed and being mounted on a rear bumper of said vehicle.

8. The improvement as defined in claim 6, wherein said gate connector being mounted on a rear bumper of said vehicle.

9. An improved spreader assembly adapted to be mounted on a vehicle, said vehicle includes a cargo bed, two sidewalls positioned opposite one another substantially on side edges of said cargo bed and extending substantially to a rear end of said cargo bed and an opening between said two sidewalls and substantially at said rear end of said cargo bed, the improvement comprising a spreader gate substantially closing said opening, a gate connector adapted to pivotably move said gate about a substantially vertical axis enabling said gate to be swung away from said cargo bed, thereby exposing said opening between said sidewalls and a spreader mount connected to said gate and extending rearwardly therefrom, said gate connector including a connector flange secured to an inner surface of one of said sidewalls.

10. The improvement as defined in claim 9, wherein said gate connector includes a connector flange secured to an inner surface of one of said sidewalls.

11. The improvement as defined in claim 1, wherein said gate connector including vertically extending sleeves and a gate flange, said sleeves adapted to receive a pin and rotate about said pin.

12. The improvement as defined in claim 10, wherein said gate connector including vertically extending sleeves and a gate flange, said sleeves adapted to receive a pin and rotate about said pin.

13. An improved spreader assembly adapted to be mounted on a vehicle, said vehicle includes a cargo bed, two sidewalls positioned opposite one another substantially on side edges of said cargo bed and extending substantially to a rear end of said cargo bed and an opening between said two sidewalls and substantially at said rear end of said cargo bed, the improvement comprising a spreader gate substantially closing said opening, a gate connector adapted to pivotably move said gate about a substantially vertical axis enabling said gate to be swung away from said cargo bed, thereby exposing said opening between said sidewalls and a spreader mount connected to said gate and extending rearwardly therefrom, said gate connector including vertically extending sleeves and a gate flange, said sleeves adapted to receive a pin and rotate about said pin, said gate flange being attached to a rear bumper of said vehicle.

14. The improvement as defined in claim 12, wherein said gate flange being attached to a rear bumper of said vehicle.

15. The improvement as defined in claim 1, wherein said spreader gate substantially closes said opening when in a closed position.

16. The improvement as defined in claim 14, wherein said spreader gate substantially closes said opening when in a closed position.

17. The improvement as defined in claim 1, wherein said spreader gate includes a frame and a panel, said panel being connected to the frame and substantially covering open spaces between said frame.

18. The improvement as defined in claim 16, wherein said spreader gate includes a frame and a panel, said panel being connected to the frame and substantially covering open spaces between said frame.

19. An improved spreader assembly adapted to be mounted on a vehicle, said vehicle includes a cargo bed, two sidewalls positioned opposite one another substantially on side edges of said cargo bed and extending substantially to a rear end of said cargo bed and an opening between said two sidewalls and substantially at said rear end of said cargo bed, the improvement comprising a spreader gate substantially closing said opening, a gate connector adapted to pivotably move said spreader gate about a substantially vertical axis enabling said gate to be swung away from said cargo bed to expose said opening between said sidewalls, and a spreader mount connected to said gate and extending rearwardly therefrom, said gate connector including a connector flange secured to an inner surface of one of said sidewalls.

20. The improvement as defined in claim 19, wherein said gate includes a first and second gate section, said gate sections positionable to one another to provide a variable longitudinal length of said gate, said first gate section includes a sleeve adapted to receive an end of said second gate section.

21. The improvement as defined in claim 19, including a gate section connector to secure said gate sections together.

22. The improvement as defined in claim 19, wherein said gate connector being positioned rearwardly of said cargo bed and at least partially mounted on a rear bumper of said vehicle.

23. The improvement as defined in claim 21, wherein said gate connector being positioned rearwardly of said cargo bed and at least partially mounted on a rear bumper of said vehicle.

24. The improvement as defined in claim 19, wherein said gate connector including vertically extending sleeves and a gate flange, said sleeves adapted to receive a pin and rotate about said pin, said gate flange attached at partially to a rear bumper of said vehicle.

25. The improvement as defined in claim 23, wherein said gate connector including vertically extending sleeves and a gate flange, said sleeves adapted to receive a pin and rotate about said pin, said gate flange attached at partially to a rear bumper of said vehicle.

26. The improvement as defined in claim 19, wherein said spreader gate includes a frame and a panel, said panel being connected to the frame and substantially covering open spaces between said frame.

27. The improvement as defined in claim 25, wherein said spreader gate includes a frame and a panel, said panel being connected to the frame and substantially covering open spaces between said frame.

28. The improvement as defined in claim 19, wherein said gate includes a first and second gate section, said gate sections adapted to vary the longitudinal length of said gate between said opening.

29. The improvement as defined in claim 28, wherein said first gate section includes a sleeve adapted to receive an end of said second gate section.

30. The improvement as defined in claim 28, including a gate section connector to secure said gate sections together.

31. The improvement as defined in claim 19, wherein said gate connector being positioned rearwardly of said cargo bed.

32. The improvement as defined in claim 19, wherein said gate connector being mounted on a rear bumper of said vehicle.

33. The improvement as defined in claim 19, wherein said gate connector includes a connector flange secured to an inner surface of one of said sidewalls.

34. The improvement as defined in claim 19, wherein said gate connector including vertically extending sleeves and a gate flange, said sleeves adapted to receive a pin and rotate about said pin.

35. The improvement as defined in claim 34, wherein said gate flange being attached to a rear bumper of said vehicle.

36. The improvement as defined in claim 19, wherein said spreader gate substantially closes said opening when in a closed position.

37. The improvement as defined in claim 19, wherein said spreader gate includes a frame and a panel, said panel being connected to the frame and substantially covering open spaces between said frame.

* * * * *